United States Patent [19]

Carr

[11] Patent Number: 4,523,427

[45] Date of Patent: Jun. 18, 1985

[54] FILAMENT YARN

[75] Inventor: Paul L. I. Carr, Dacre Banks, England

[73] Assignee: Imperial Chemical Industries Limited, London, England

[21] Appl. No.: 642,739

[22] Filed: Aug. 20, 1984

Related U.S. Application Data

[63] Continuation of Ser. No. 430,911, Sep. 30, 1982, abandoned.

[30] Foreign Application Priority Data

Oct. 26, 1981 [GB] United Kingdom ..... 8132250

[51] Int. Cl.[3] ..... D02G 3/06

[52] U.S. Cl. ..... 57/248; 57/260; 428/370

[58] Field of Search ..... 57/31, 200, 248, 255, 57/260, 284; 28/259; 264/168, 288.8; 428/369, 370, 373

[56] References Cited

U.S. PATENT DOCUMENTS

| | | | |
|---|---|---|---|
| 3,345,815 | 10/1967 | Starkie et al. | 57/248 X |
| 3,533,904 | 10/1970 | Jurkiewitsch | 428/370 |
| 3,677,880 | 7/1972 | Fukuma et al. | 428/370 |
| 3,681,912 | 8/1972 | Silverman | 57/260 X |
| 4,055,941 | 11/1977 | Rivers et al. | 57/248 |

*Primary Examiner*—Donald Watkins
*Attorney, Agent, or Firm*—S. M. Bodenheimer, Jr.

[57] ABSTRACT

A yarn of a synthetic, fibre-forming, polymeric material comprising a plurality of filaments having a substantially rectangular cross-section and having a birefringence asymmetry across the width of the filaments, each of the filaments being twisted about the longitudinal axis of the filament in such a manner that the overall lateral dimension of the twisted filament corresponds substantially with the length of the rectangular cross-section of the filament.

3 Claims, 1 Drawing Figure

FILAMENT YARN

Figure 1:
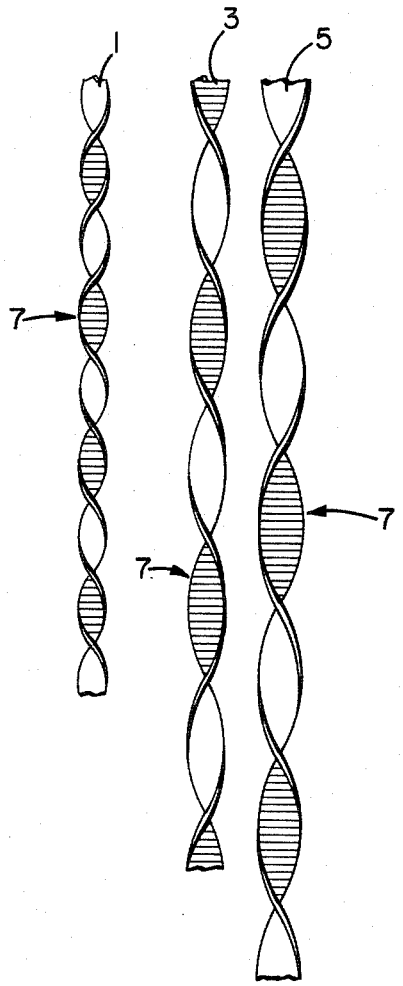

This application is a continuation of application Ser. No. 430,911, filed Sept. 30, 1982 now abandoned.

This invention relates to an improved filament yarn of a synthetic, fibre-forming, polymeric material, such as a polyester or a polyamide, and to methods of producing such a yarn.

According to the present invention we provide a yarn of a synthetic, fibre-forming, polymeric material comprising a plurality of filaments having a substantially rectangular cross-section and having a birefringence asymmetry across the width of the filaments, each of the filaments being twisted about the longitudinal axis of the filament in such a manner that the overall lateral dimension of the twisted filament corresponds substantially with the length of the rectangular cross-section of the filament.

FIG. 1 illustrates three filaments of a yarn of the invention. Each of the filaments, 1, 2 and 3, has a rectangular cross-section and is twisted about its longitudinal axis in such a manner that the overall lateral dimension of the twisted filament corresponds substantially with the length of the rectangular cross-section of the filament. The frequency of twist in each filament, 1, 2 and 3, is different. Additionally, it can be seen that the twist in each of the filaments, 1, 2 and 3 reverses itself at random intervals, as shown at 7.

The filaments in the yarn of the invention differ from known helically crimped filaments in that the known helically crimped filaments have an overall lateral dimension which greatly exceeds the lateral dimension of the filament in its spun form whereas the twisted filaments in the yarn of the invention have an overall lateral dimension which corresponds substantially with the lateral dimension of the filament in its spun form.

Preferred filaments are those having a frequency of twist between 10 and 80 twists/cm. However, although all of the filaments in the yarn may have a twist frequency in the above range, it is preferable that each of the filaments has a different, and more preferably considerably different, twist frequency.

A further feature of the filaments of the invention is that the twist therein, reverses itself at random intervals along the length of the filaments.

We have found that filaments having a rectangular, ie tape, cross-section, twist in the manner described above if a birefringence asymmetry is induced across the width of the filaments as they are being spun. Conveniently this can be achieved by cooling one side of the tape section filament more than the other side of the filament during the spinning process. Such a process is described in U.S. Pat. No. 4,038,357 in relation to the asymmetric cooling of circular cross section filaments. The described process produces helically crimped filaments having an overall lateral dimension which greatly exceeds the lateral dimension of the filament in its spun form.

A suitable air cooling device can be chosen appropriate to the particular arrangement of filaments as they leave the spinneret. Thus, for example, an outflow quench can be used if the filaments are arranged in a tangential manner around the circumference of a circle.

In Example 2 given below, the mean birefringence of the tape section filaments was $38\times10^{-3}$. The birefringence differential across the width of the filaments was difficult to measure for two reasons. First the filaments are not exactly rectangular in cross section, and second it is difficult to align the filaments accurately to be viewed edge on in the polarizing microscope. However some approximate measurements have been made and in Example 2 the birefringence differential across the width of as-spun filaments varied from $3.2\times10^{-3}$ to $3.8\times10^{-3}$. However the existence of this birefringence differential, and consequently a shrinkage differential across the filaments, is readily demonstrated by allowing a short length of a spun single filament to shrink freely on a hot stage microscope. As the temperature is raised the filament curls into a flat hairspring whose plane is perpendicular to the large dimension of the filament cross section.

Alternatively, a shrinkage differential across the filaments can be obtained by spinning a yarn composed of side by side heterofilaments, from two polymers which when spun and drawn separately under the same conditions, would give yarns with different linear shrinkages. A suitable polymer combination is polyethylene terephthalate and polyethylene isophthalate/polyethylene terephthalate copolymer. A 50/50 bicomponent fibre is satisfactory but alternative proportions also produce the same effect to varying degrees. In the copolymer, isophthalate levels of 5–10 mole% are generally sufficient to produce a sufficiently high shrinkage in the copolymer component. Many other polymer combinations can be used to produce the desired shrinkage differential, including different molecular weight samples of the same polymer. Side by side heterofilaments can be spun with the polymer split occurring along the long axis of the filament cross section. Spinnerets and distribution plates designed to produce side by side circular filaments are well known in the art and a similar distribution in tape section filaments can be obtained with small modifications.

Filament yarns according to the invention can be produced from any of the usual synthetic linear polymers which can be melt-spun into individual filaments such as polyesters, polyamides, copolyesters, copolyamides or polyolefines in particular, for example, polyethylene terephthalate and its copolyesters, polyepsilon-caproamide, polyhexamethylene adipamide, polypropylene and the like. These polymers can be spun into very fine individual filaments which can then be combined into a yarn.

The invention will now be described by way of the following Examples:

EXAMPLE 1

A multifilament yarn was spun from a polyethylene terephthalate polymer having an IV of 0.675 using an annular spinneret containing 24 rectangular holes having the dimensions 0.060 inch×0.0015 inch disposed perpendicular to the radius of the spinneret. The yarn was wound up at 4,000 m/min to give a 160 f24 spun yarn. The filaments, as they left the spinneret, were cooled by means of a central outflow air quench so that all of the filaments were cooled preferentially on one side. Air velocities over the first 10 cm of the quench candle were of the order of 75–100 m/min measured at the relevant filament/quench distance. The air temperature was 25° C.

Varying degrees of crimp (twist) were imparted to the filaments in the spun yarn so formed by allowing samples of the yarn to shrink in hot air at 150° C. under various loads from 0.0001 to 0.01 gms/decitex.

Spun yarn was also drawn over a pin at 75° C. to give a drawn yarn with high shrinkage; crimp (twist) then being imparted to the filaments in the yarn as above.

The yarn produced was tension resistant and the bulk and textured appearance of the yarn derives from the way the twisted tape sections pack together in the yarn and the way light is reflected from the twisted surfaces.

EXAMPLE 2

A yarn was spun from polyethylene terephthalate polymer having an IV of 0.67, using an annular spinneret containing 24 rectangular holes having dimensions 0.060×0.065 inch, disposed perpendicular to the radius of the spinneret. The yarn was wound up at 2500 m/min to give a 136 f 24 spun yarn. The filaments were preferentially cooled on one side as they left the spinneret using the quench and quench conditions of Example 1. This yarn was then drawn and relaxed in a combined process to produce an attractive bulked yarn with a natural appearance and handle when knitted into fabric. The draw stage employed a conventional heated feed roll at 77° C. and a hot plate at 86° C. The draw speed was 250 m/min, and draw ratio 1.5. The yarn was then passed through an expanding hot air jet with an air temperature on the inlet to the jet at 190° C. The expansion jet minimised the yarn tension during the relaxation process and a relax ratio of 40–50% was achieved. Final properties of this yarn were Decitex 124 f20. Tenacity 14.5 cN/Tex extension to break 34%. Modulus 330 cN/Tex. Boiling water shrinkage 3.3%. Crimp in individual filaments varied from 10 to 40 twists per cm.

I claim:

1. A yarn of a synthetic, fibre-forming, polymeric material comprising a plurality of filaments having a substantially rectangular cross-section and having a birefringence asymmetry across the width of the filaments, each of the filaments being twisted about the longitudinal axis of the filament in such a manner that the overall lateral dimension of the twisted filament corresponds substantially with the length of the rectangular cross-section of the filament, the frequency of twist of a filament in the yarn differing from the frequency of twist of all the other filaments in the yarn and the twist in all of the filaments reversing itself at random intervals along the length of the filaments.

2. A yarn as claimed in claim 1 in which the filaments have a frequency of twist between 10 and 80 twists/cm.

3. A yarn as claimed in claim 2 in which all of the filaments in the yarn have a different twist frequency between 10 and 80 twists/cm.

* * * * *